US009418614B2

(12) United States Patent
Inagaki

(10) Patent No.: US 9,418,614 B2
(45) Date of Patent: Aug. 16, 2016

(54) LIQUID CRYSTAL DISPLAY APPARATUS AND METHOD FOR CONTROLLING THE SAME

(71) Applicant: CANON KABUSHIKI KAISHA, Tokyo (JP)

(72) Inventor: Kensuke Inagaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 13/647,212

(22) Filed: Oct. 8, 2012

(65) Prior Publication Data

US 2013/0088475 A1 Apr. 11, 2013

(30) Foreign Application Priority Data

Oct. 11, 2011 (JP) ..... 2011-224185

(51) Int. Cl.

*G09G 5/10* (2006.01)
*G09G 3/36* (2006.01)
*G09G 3/20* (2006.01)

(52) U.S. Cl.

CPC ..... *G09G 3/3688* (2013.01); *G09G 3/2018* (2013.01); *G09G 3/2081* (2013.01); *G09G 3/3685* (2013.01)

(58) Field of Classification Search

CPC .... G09G 3/231; G09G 3/3685; G09G 3/2081
USPC ..... 345/208, 690
See application file for complete search history.

(56) References Cited

U.S. PATENT DOCUMENTS

| | | | | |
|---|---|---|---|---|
| 5,583,535 | A * | 12/1996 | Takarada et al. | 345/99 |
| 6,034,787 | A * | 3/2000 | Hashimoto et al. | 358/1.9 |
| 6,057,809 | A * | 5/2000 | Singhal et al. | 345/3.3 |
| 6,160,533 | A * | 12/2000 | Tamai et al. | 345/89 |
| 6,842,160 | B2 * | 1/2005 | Yamazaki et al. | 345/76 |
| 7,573,472 | B2 * | 8/2009 | Aoki et al. | 345/208 |
| 8,223,209 | B2 * | 7/2012 | Ono | 348/207.1 |
| 2006/0044220 | A1 * | 3/2006 | Van Dijk | G09G 3/2014 345/55 |
| 2011/0001701 | A1 * | 1/2011 | Nakano | 345/157 |

FOREIGN PATENT DOCUMENTS

JP 3367808 B2 1/2003

* cited by examiner

*Primary Examiner* — Chanh Nguyen
*Assistant Examiner* — Yuzhen Shen
(74) *Attorney, Agent, or Firm* — Canon U.S.A., Inc. IP Division

(57) ABSTRACT

There is provided a liquid crystal display apparatus capable of preventing image degradation when driving a liquid crystal panel. In the liquid crystal display apparatus, a control unit, when there are more pixels indicating the first gradation than the second gradation, controls the supply state of the pixel voltage simultaneously supplied to the plurality of pixel electrodes to prolong the time period between the timing of changing the supply state of the pixel voltage corresponding to the first gradation and the timing of changing the supply state of the pixel voltage corresponding to the second gradation so as to become longer than that when there are fewer pixels indicating the first gradation than the second gradation.

19 Claims, 9 Drawing Sheets

FIG. 6A

| | NUMBER OF PIXELS | | | | | | | |
|---|---|---|---|---|---|---|---|---|
| | GRADATION 0 | GRADATION 1 | GRADATION 2 | GRADATION 3 | GRADATION 4 | GRADATION 5 | GRADATION 6 | GRADATION 7 |
| 1ST ROW | 15 | 15 | 15 | 15 | 15 | 15 | 15 | 15 |
| : | : | : | : | : | : | : | : | : |
| A-TH ROW | 15 | 25 | 15 | 5 | 15 | 5 | 20 | 20 |
| : | : | : | : | : | : | : | : | : |
| B-TH ROW | 0 | 0 | 30 | 60 | 30 | 0 | 0 | 0 |
| : | : | : | : | : | : | : | : | : |

FIG. 6B

| NUMBER OF PIXELS | NEXT GRADATION DELAY |
|---|---|
| 0-29 | 0 |
| 30-59 | 1 |
| 60-89 | 2 |
| 90-120 | 3 |

FIG. 6C

| | NEXT GRADATION DELAY CLOCK | | | | | | | |
|---|---|---|---|---|---|---|---|---|
| | GRADATION 0 | GRADATION 1 | GRADATION 2 | GRADATION 3 | GRADATION 4 | GRADATION 5 | GRADATION 6 | GRADATION 7 |
| 1ST ROW | 0 | 0 | 0 | 0 | 0 | 0 | 0 | 0 |
| : | : | : | : | : | : | : | : | : |
| A-TH ROW | 0 | 0 | 0 | 0 | 0 | 0 | 0 | 0 |
| : | : | : | : | : | : | : | : | : |
| B-TH ROW | 0 | 0 | 1 | 2 | 1 | 0 | 0 | 0 |
| : | : | : | : | : | : | : | : | : |

FIG. 6D

| | DELAY CLOCK | | | | | | | |
|---|---|---|---|---|---|---|---|---|
| | GRADATION 0 | GRADATION 1 | GRADATION 2 | GRADATION 3 | GRADATION 4 | GRADATION 5 | GRADATION 6 | GRADATION 7 |
| 1ST ROW | 0 | 0 | 0 | 0 | 0 | 0 | 0 | 0 |
| : | : | : | : | : | : | : | : | : |
| A-TH ROW | 0 | 0 | 0 | 0 | 0 | 0 | 0 | 0 |
| : | : | : | : | : | : | : | : | : |
| B-TH ROW | 0 | 0 | 0 | 1 | 2 | 1 | 0 | 0 |
| : | : | : | : | : | : | : | : | : |

LIQUID CRYSTAL DISPLAY APPARATUS AND METHOD FOR CONTROLLING THE SAME

BACKGROUND OF THE INVENTION

1. Field of the Invention

The present invention relates to a liquid crystal display (LCD) apparatus and a method for controlling the liquid crystal display apparatus.

2. Description of the Related Art

Conventionally, liquid crystal monitors and projectors are known as LCD apparatuses. These LCD apparatuses control the transmissivity of light from a light source by using a liquid crystal panel to display gradations corresponding to an image. To accomplish this control, the LCD apparatuses change a potential difference between a common electrode of the liquid crystal panel and a pixel electrode corresponding to each pixel (i.e., a voltage applied to a liquid crystal between electrodes) to control the polarization direction of the liquid crystal of each pixel of the liquid crystal panel, thus changing the transmissivity of light.

In recent years, some of such LCD apparatuses have employed a new technique for changing the transmissivity of each pixel of the liquid crystal panel. Specifically, the technique maintains a common electrode at a constant voltage, simultaneously inputs a ramp signal having a monotonically changing voltage to each pixel electrode, and turns OFF a switch corresponding to each pixel electrode at a timing according to a gradation displayed by each pixel.

Even this technique enables charging a voltage to each pixel electrode similar to conventional liquid crystal panels, making it possible to change the transmissivity of light of each pixel of the liquid crystal panel as discussed, for example, in Japanese Patent No. 3367808.

To display an image of one line in the horizontal direction, this technique simultaneously inputs a ramp signal having a monotonically increasing voltage to each pixel electrode in one line of the liquid crystal panel, and turns off a switch corresponding to each pixel electrode at a timing according to an image value (gradation to be displayed) of each pixel. In particular, in Japanese Patent No. 3367808, a monotonically increasing ramp signal generated by one reference voltage source 41 for charging pixel voltage is simultaneously applied to each pixel electrode for one line in the horizontal direction (see FIGS. 1 and 2). That is, each pixel electrode in one line shares the monotonically increasing ramp signal generated by the one reference voltage source for charging pixel voltage.

However, when the liquid crystal panel is driven by the method as discussed in Japanese Patent No. 3367808, for example, if there are many pixels having the same gradation (gradation A) in one line as illustrated in FIG. 8A, switches corresponding to many pixel electrodes are simultaneously turned off at a timing when the ramp signal reaches a voltage corresponding to gradation A.

In this case, a load on the one power supply for charging pixel voltage rapidly changes to result in a turbulent ramp signal. In the case illustrated in FIG. 8A, for example, many switches turn off at the same time at a timing corresponding to many gradations A. As a result, the ramp signal corresponding to gradations after gradation A becomes turbulent, as illustrated in FIG. 8B.

If pixel electrode switches corresponding to pixels for displaying gradation B are turned off in a state where the ramp signal corresponding to gradation B (gradation after gradation A) is turbulent, the charge voltage to the pixel electrodes of the pixels for displaying gradation B may become a voltage not corresponding to gradation B.

In this case, the transmissivity of the pixels which should display gradation B of the liquid crystal panel becomes different from the transmissivity of the pixels for displaying gradation B. This signal turbulence is an example, and may be larger for a longer time period. In the example illustrated in FIG. 8A, there has been a problem that a degraded image is presented to a user since the image of gradation B may become brighter or darker than gradation B although the image of gradation A is correctly displayed.

SUMMARY OF THE INVENTION

The present invention is directed to a liquid crystal display apparatus and a method for controlling the liquid crystal display apparatus capable of preventing image degradation when driving a liquid crystal panel.

According to an aspect of the present invention, a liquid crystal display apparatus including a liquid crystal device, includes an acquisition unit configured to acquire an image, a gradation signal generation unit configured to generate a gradation signal which provides a value indicating a first gradation and then a value indicating a second gradation in synchronization with a horizontal synchronization signal of the image acquired by the acquisition unit, a voltage generation unit configured to generate a pixel voltage, based on the gradation signal, to be simultaneously supplied to a plurality of pixel electrodes for liquid crystal pixels of the liquid crystal device, and a control unit configured to, based on a pixel value of each pixel of the image acquired by the acquisition unit and a value of the pixel voltage, control a supply state of the pixel voltage to the plurality of pixel electrodes simultaneously supplied with the pixel voltage, wherein, when there are more pixels indicating the first gradation than the second gradation, the control unit controls the supply state of the pixel voltage to the plurality of pixel electrodes simultaneously supplied with the pixel voltage to prolong the time period between the timing of changing the supply state of the pixel voltage corresponding to the first gradation and the timing of changing the supply state of the pixel voltage corresponding to the second gradation so as to become longer than that when there are fewer pixels indicating the first gradation than the second gradation.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 6A to 6D illustrate a result of analysis by the image analysis unit, and tables for determining a delay amount of a comparison signal.

DESCRIPTION OF THE EMBODIMENTS

Various exemplary embodiments, features, and aspects of the invention will be described in detail below with reference to the drawings.

An exemplary embodiment will be described below centering on a liquid crystal projector as an example of an LCD apparatus. However, the present invention is not limited to a liquid crystal projector but applicable to any displays having a liquid crystal device, such as liquid crystal televisions, liquid crystal monitors, and electronic devices having a liquid crystal display unit. Although single-panel and 3-panel types are generally known as liquid crystal projectors, the present invention is applicable to both types.

The liquid crystal projector according to the present exemplary embodiment controls the transmissivity of light of a liquid crystal device according to an image to be displayed to project on a screen the light from a light source which has transmitted through the liquid crystal device, thus presenting the image to the user. In the present exemplary embodiment, a liquid crystal control unit simultaneously supplies a varying pixel voltage to a plurality of liquid crystal pixels of the liquid crystal device. The varying pixel voltage is used to control the transmissivity of the liquid crystal to be the transmissivity corresponding to a plurality of gradations to be displayed.

When the supplied pixel voltage becomes a voltage corresponding to a specific gradation, the liquid crystal control unit changes the supply state of the pixel voltage to the liquid crystal pixels which should display the specific gradation (in the present exemplary embodiment, from the supply state to the non-supply state), thus controlling the liquid crystal device. A liquid crystal projector based on such a method will be described below.

<Overall Configuration>

Figure 1:
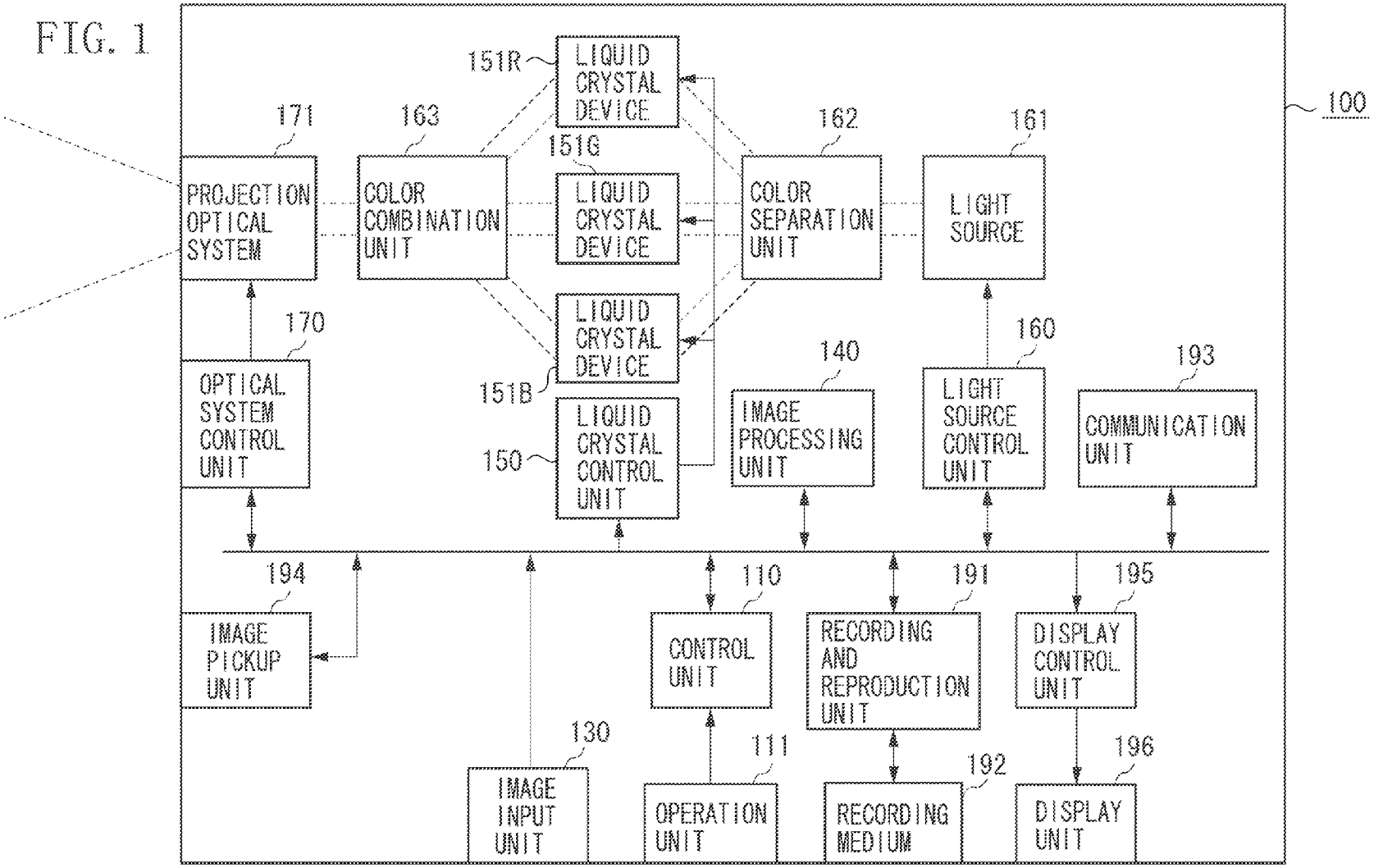
FIG. 1 is a block diagram illustrating an overall configuration of a liquid crystal projector.

An overall configuration of the liquid crystal projector according to the present exemplary embodiment will be described below with reference to FIG. 1. FIG. 1 illustrates the overall configuration of a liquid crystal projector 100 according to the present exemplary embodiment.

The liquid crystal projector 100 according to the present exemplary embodiment includes a control unit 110, an operation unit 111, an image input unit 130, and an image processing unit 140. The liquid crystal projector 100 further includes a liquid crystal control unit 150, liquid crystal devices 151R, 151G, and 151B, a light source control unit 160, a light source 161, a color separation unit 162, a color combination unit 163, an optical system control unit 170, and a projection optical system 171. The liquid crystal projector 100 may further include a recording and reproduction unit 191, a recording medium 192, a communication unit 193, an image pickup unit 194, a display control unit 195, and a display unit 196.

The control unit 110 controls each operation unit of the liquid crystal projector 100. The control unit 110 includes, for example, a central processing unit (CPU), a memory, and a microprocessor. The recording and reproduction unit 191 can reproduce still and video images of still and moving image data read from the recording medium 192 and still and moving image data received via the communication unit 193.

Still and video images acquired by the image pickup unit 194 can be converted into still and moving image data, respectively, and recorded in the recording medium 192. The operation unit 111 receives a user instruction and transmits a relevant instruction signal to the control unit 110. The operation unit 111 includes, for example, switches, dials, and a touch panel provided on the display unit 196.

The operation unit 111 may transmit a predetermined instruction signal to the control unit 110 based on a signal received by a signal receiving unit (such as an infrared receiving unit) configured to receive a signal from a remote controller. The control unit 110 receives a control signal input from the operation unit 111 and the communication unit 193, and controls each operation unit of the liquid crystal projector 100.

The image input unit 130 receives a video signal from an external apparatus. The image input unit 130 includes a composite terminal, a separate (S) video terminal, a digital (D) terminal, a component terminal, an analog red/green/blue (RGB) terminal, a digital visual interface-A (DVI-A) terminal, a digital visual interface-D (DVI-D) terminal, and a high-definition multimedia interface (HDMA: registered trademark) terminal. Upon reception of an analog video signal, the image input unit 130 converts the received analog video signal into a digital video signal, and transmits the received video signal to the image processing unit 140.

The external apparatus may be any apparatus capable of outputting a video signal, such as a personal computer, a camera, a mobile phone, a smart phone, a hard disk recorder, and a game machine.

The image processing unit 140 applies processing for changing the number of frames, number of pixels, and image shape to the video signal received from the video input unit 130, and transmits the changed video signal to the liquid crystal control unit 150. The image processing unit 140 includes, for example, a microprocessor for image processing.

The image processing unit 140 is not necessarily a dedicated microprocessor and may be, for example, a part of the processing function of the CPU and memory or the microprocessor operating the control unit 110. The image processing unit 140 is capable of executing interframe thinning processing, frame interpolation processing, resolution conversion processing, and distortion correction processing (keystone correction process).

In addition to the video signal received from the video input unit 130, the image processing unit 140 is further capable of applying the above-described change processing to still and video images reproduced by the control unit 110.

The liquid crystal control unit 150 controls a voltage to be applied to the liquid crystal of a pixel composed of the liquid crystal devices 151R, 151G, and 151B based on the video signal processed by the image processing unit 140 to adjust the transmissivity of the liquid crystal devices 151R, 151G, and 151B. The liquid crystal control unit 150 includes a microprocessor for control.

The liquid crystal control unit 150 is not necessarily a dedicated microprocessor and may be, for example, a part of the processing function of the CPU and memory or microprocessor operating the control unit 110. For example, when a video signal is input to the image processing unit 140, the liquid crystal control unit 150 controls, each time one-frame image is received from the image processing unit 140, the liquid crystal devices 151R, 151G, and 151B so as to provide the transmissivity corresponding to the image.

The liquid crystal device 151R, which is a liquid crystal device for red, adjusts the transmissivity of red light out of red (R), green (G), and blue (B) color components separated by the color separation unit 162 out of the light output from the light source 161.

The liquid crystal device 151G, which is a liquid crystal device for green, adjusts the transmissivity of green light out of red (R), green (G), and blue (B) color components separated by the color separation unit 162 out of the light output from the light source 161. The liquid crystal device 151B, which is a liquid crystal device for blue, adjusts the transmissivity of blue light out of red (R), green (G), and blue (B) color components separated by the color separation unit 162 out of the light output from the light source 161.

Operations performed by the liquid crystal control unit 150 to control the liquid crystal devices 151R, 151G, and 151B, and the configurations of the liquid crystal devices 151R, 151G, and 151B will be described below.

The light source control unit 160 controls the ON/OFF state and the light quantity of the light source 161. The light source control unit 160 includes a microprocessor for control. The light source control unit 160 is not necessarily a dedicated microprocessor and may be, for example, a part of the processing function of the CPU and memory or microprocessor operating the control unit 110.

The light source 161 outputs light for projecting an image on a screen (not illustrated), and may be a halogen lamp, a xenon lamp, or a high-pressure mercury vapor lamp. The color separation unit 162 separates the light output from the light source 161 into red (R), green (G), and blue (B) color components. The color separation unit 162 includes, for example, a dichroic mirror and a prism. When light emitting diodes (LEDs) corresponding to respective colors are used as the light source 161, the color separation unit 162 is not required.

The color combination unit 163 combines red (R), green (G), and blue (B) color components which have transmitted through the liquid crystal devices 151R, 151G, and 151B. The color combination unit 163 includes, for example, a dichroic mirror and a prism. The color combination unit 163 combines the red (R), green (G), and blue (B) color components and transmits the resultant light to the projection optical system 171.

In this case, the liquid crystal devices 151R, 151G, and 151B are controlled by the liquid crystal control unit 150 so as to provide the transmissivity of light corresponding to an image input by the image processing unit 140. Therefore, when the light combined by the color combination unit 163 is projected on the screen by the projection optical system 171, an image corresponding to the image input by the image processing unit 140 is displayed on the screen.

The optical system control unit 170 controls the projection optical system 171. The optical system control unit 170 includes a microprocessor for control. The optical system control unit 170 is not necessarily a dedicated microprocessor and may be, for example, a part of the processing function of the CPU and memory or microprocessor operating the control unit 110.

The projection optical system 171 projects on the screen the combined light output from the color combination unit 163. The projection optical system 171 includes a plurality of lenses and an actuator for driving the lenses. Driving the lenses with the actuator enables enlarging and reducing the projected image and performing focal point adjustment therefor.

The recording and reproduction unit 191 reproduces still and moving image data from the recording medium 192, receives still and moving image data for still and video images obtained by the image pickup unit 194 from the control unit 110, and records these pieces of data on the recording medium 192. The recording and reproduction unit 191 may record on the recording medium 192 the still and moving image data received from the communication unit 193.

The recording and reproduction unit 191 includes, for example, an interface for electrically connecting with the recording medium 192 and a microprocessor for communicating with the recording medium 192. The recording and reproduction unit 191 does not necessarily include a dedicated microprocessor. The function of communicating with the recording medium 192 may be achieved by a part of the processing function of the CPU and memory or microprocessor operating the control unit 110.

The recording medium 192 is a medium capable of recording still and moving image data and control data required for the liquid crystal projector 100 according to the present exemplary embodiment. The recording medium 192 may be any type of a recording medium such as a magnetic disk, an optical disk, and a semiconductor memory, and may further be detachably attached to or included in the liquid crystal projector 100.

The communication unit 193 receives a control signal, still image data, and moving image data from an external device. The communication method of the communication unit 193 may be, for example, a wireless local area network (LAN), a wired LAN, a universal serial bus (USB), or Bluetooth (registered trademark).

When the terminal of the image input unit 130 is, for example, an HDMA (registered trademark) terminal, consumer electronics control (CEC) communication may be performed via the HDMA terminal. The external apparatus may be any apparatus capable of communicating with the liquid crystal projector 100, such as a personal computer, a camera, a mobile phone, a smart phone, a hard disk recorder, a game machine, and a remote control.

The image pickup unit 194 captures an image of a subject and acquires an image signal. For example, the image pickup unit 194 is capable of capturing an image (screen direction) projected via the projection optical system 171. The image pickup unit 194 transmits the acquired still and moving images to the control unit 110. The control unit 110 converts the still and moving images into still and moving image data, respectively.

The image pickup unit 194 includes a lens for acquiring an optical image of a subject, an actuator for driving the lens, a microprocessor for controlling the actuator, an image sensor for converting the optical image acquired via the lens into an image signal, and an analog-to-digital (A/D) converter for converting the image signal acquired by the image sensor into a digital signal. The image-capturing direction of the image pickup unit 194 is not limited to the screen direction and may be, for example, the viewer side opposite to the screen.

The display control unit 195 performs control to display on the display unit 196 provided on the liquid crystal projector 100 an operation screen and images of switch icons for operating the liquid crystal projector 100. The display control unit 195 includes a microprocessor for display control.

This microprocessor is not necessarily a dedicated microprocessor for the display control unit 195 and may be, for example, a part of the processing function of the CPU and memory or microprocessor operating the control unit 110. The display unit 196 displays an operation screen and switch icons for operating the liquid crystal projector 100. The display unit 196 may be any type of display as long as it can display images.

The display unit 196 may be, for example, a liquid crystal display, a cathode ray tube (CRT) display, an organic electroluminescence (EL) display, or an LED display. An LED corresponding to each button may light up to enable a user to recognize a specific button.

The image processing unit 140, the liquid crystal control unit 150, the light source control unit 160, the optical system control unit 170, the recording and reproduction unit 191, and the display control unit 195 according to the present exemplary embodiment may be a single or a plurality of microprocessors capable of performing similar processing to the processing of each of these blocks. Alternatively, the CPU and memory or microprocessor of the control unit 110 may perform similar processing.

<Basic Operations>

Basic operations performed by the liquid crystal projector 100 according to the present exemplary embodiment will be described below with reference to FIGS. 1 and 2.

Figure 2:
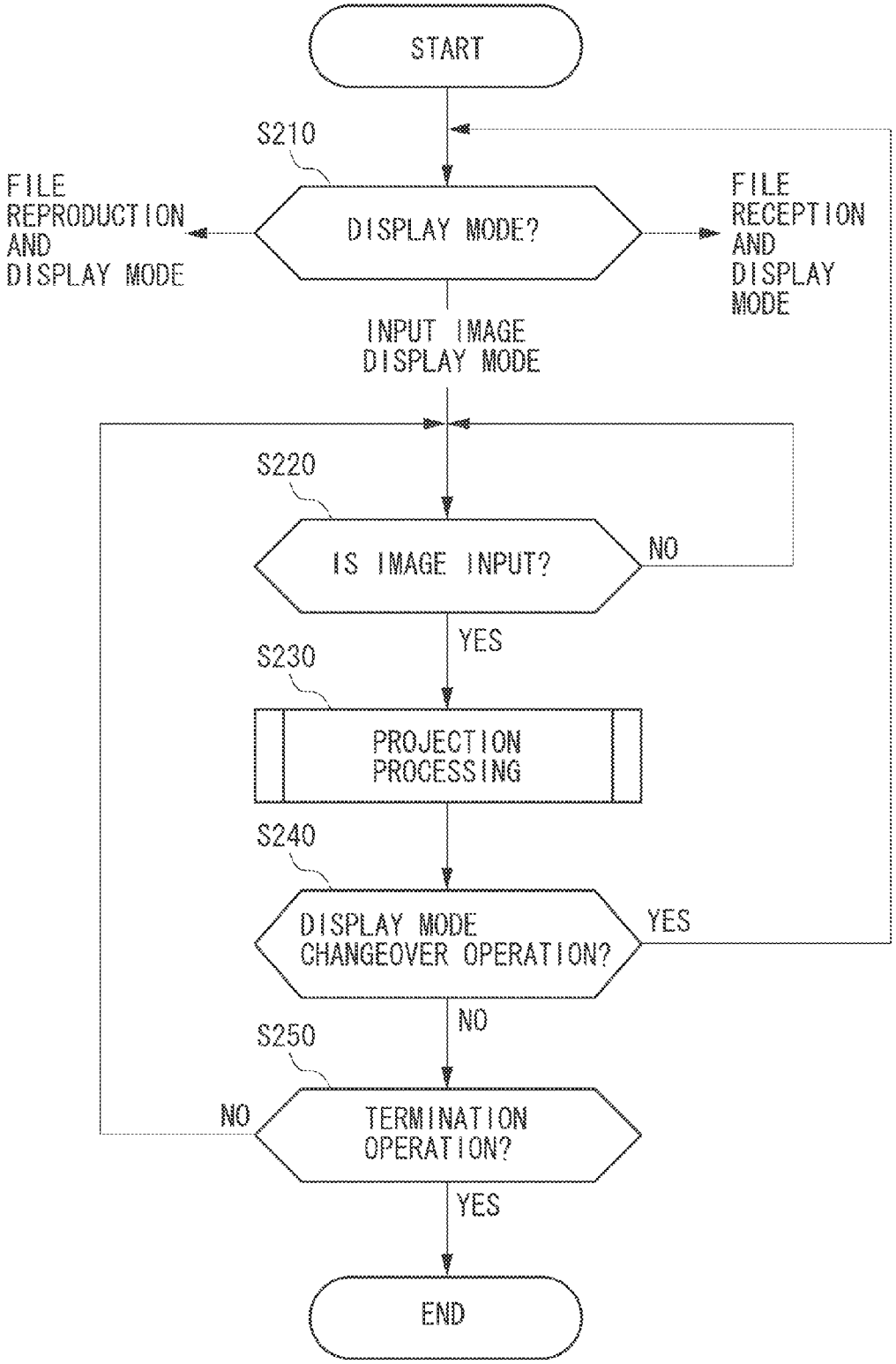
FIG. 2 is a flowchart illustrating control of basic operations of a liquid crystal projector according to an exemplary embodiment of the present invention.

FIG. 2 is a flowchart illustrating control of basic operations of the liquid crystal projector 100 according to the present exemplary embodiment. Basically, the operations illustrated in FIG. 2 are implemented when the control unit 110 controls each of the above-described function blocks. The flowchart illustrated in FIG. 2 starts at a time when the user instructs to turn ON the power of the liquid crystal projector 100 via the operation unit 111 or a remote control (not illustrated).

When the user instructs to turn ON the power of the liquid crystal projector 100 via the operation unit 111 or a remote control (not illustrated), the control unit 110 supplies the power from a power supply unit (not illustrated) to each unit of the liquid crystal projector 100 via a power supply circuit (not illustrated).

In step S210, the control unit 110 determines a display mode selected by the user by operating the operation unit 111 or the remote controller. The "input image display mode" is one of display modes of the liquid crystal projector 100 according to the present exemplary embodiment, in which an image input from the image input unit 130 is displayed. The "file reproduction and display mode" is one of display modes of the liquid crystal projector 100 according to the present exemplary embodiment, in which still and video images of the still and moving image data read from the recording medium 192 by the recording and reproduction unit 191 are displayed.

The "file reception and display mode" is one of display modes of the liquid crystal projector 100 according to the present exemplary embodiment, in which still and video images of the still and moving image data received via the communication unit 193 are displayed. Although the present exemplary embodiment will be described below based on a case where a display mode is selected by the user, the display mode when the power is turned ON may be the display mode when the liquid crystal projector 100 was last turned off, and any one of the above-described display modes may be a default display mode. In this case, the processing in step S210 can be omitted.

The present exemplary embodiment will be described below on the premise that the user selects the "input image display mode" in step S210. When the user selects the "input image display mode" in step S210, then in step S220, the control unit 110 determines whether an image is input from the image input unit 130. When an image is not input (NO in step S220), the processing waits until image input is detected. When an image is input (YES in step S220), then in step S230, the control unit 110 performs projection processing.

The control unit 110 transmits to the image processing unit 140 the image input from the image input unit 130 as projection processing, instructs the image processing unit 140 to change the number of pixels of a video image and the frame rate, and perform shape change (for example, trapezoidal correction), and transmits a processed image for one screen to the liquid crystal control unit 150.

Then, the control unit 110 instructs the liquid crystal control unit 150 to control the transmissivity of the liquid crystal panels 151R, 151G, and 151B to provide the transmissivity according to the gradation level of each of the red (R), green (G), and blue (B) color components of the received image for one screen. Then, the control unit 110 instructs the light source control unit 160 to control the output of light from the light source 161. The color separation unit 162 separates the light output from the light source 161 into red (R), green (G), and blue (B) color components, and supplies respective light components to the liquid crystal panels 151R, 151G, and 151B.

With the light components supplied to the liquid crystal panels 151R, 151G, and 151B, the transmitting light quantity is limited for each pixel of each liquid crystal panel. The red (R), green (G), and blue (B) color components which have transmitted through the liquid crystal panels 151R, 151G, and 151B, respectively, are supplied to the color combination unit 163 for recombination. Then, the light combined by the color combination unit 163 is projected on a screen (not illustrated) via the projection optical system 171.

During image projection, this projection processing is sequentially performed for each image for one frame. When the user input an instruction for operating the projection optical system 171 from the operation unit 111, the control unit 110 instructs the optical system control unit 170 to control the actuator of the projection optical system 171 so as to change the focus of the projected image and the magnification of the projection optical system 171.

During execution of display processing, in step S240, the control unit 110 determines whether the user inputs an instruction for changing the display mode from the operation unit 111. When the user inputs the instruction for changing the display mode from the operation unit 111 (YES in step S240), the processing returns to step S210 to determine the display mode.

In this case, the control unit 110 transmits to the image processing unit 140 a menu screen for display mode selection as an on-screen display (OSD) image, and controls the image processing unit 140 to superimpose the OSD screen on the projected image. The user selects a display mode while monitoring the projected OSD screen.

Otherwise, when the user does not input the instruction for changing the display mode from the operation unit 111 during execution of display processing (NO in step S240), then in step S250, the control unit 110 determines whether the user inputs an instruction for terminating projection from the operation unit 111.

When the user inputs the instruction for terminating projection from the operation unit 111 (YES in step S250), the control unit 110 stops the power supply to each block of the liquid crystal projector 100 to terminate image projection. On the other hand, when the user does not input the instruction for terminating projection from the operation unit 111 (NO in step S250), the control unit 110 returns the processing to step S220. Subsequently, the control unit 110 repeats the processing in steps S220 to S250 until the user inputs the instruction for terminating projection from the operation unit 111.

As described above, the liquid crystal projector 100 according to the present exemplary embodiment projects an image on the screen.

In the "file reproduction and display mode", the control unit 110 instructs the recording and reproduction unit 191 to read from the recording medium 192 a file list of still and moving image data and thumbnail data for each file.

Then, the control unit 110 generates texts and images based on the read file list and images based on the thumbnail data for each file, and transmits the images to the image processing unit 140. Then, the control unit 110 controls the image processing unit 140, the liquid crystal control unit 150, and the light source control unit 160, similar to the regular projection processing performed in step S230.

Then, on the projected image, the user inputs an instruction for selecting text and image corresponding to still and moving image data recorded in the recording medium 192 via the operation unit 111. Then, the control unit 110 controls the recording and reproduction unit 191 to read the selected still and moving image data from the recording medium 192. The recording and reproduction unit 191 reproduces still and video images of the read still and moving image data.

Then, the control unit 110 sequentially transmits, for example, video images of the reproduced moving image data to the image processing unit 140, and controls the image processing unit 140, the liquid crystal control unit 150, and the light source control unit 160, similar to the regular projection processing performed in step S230. When the still image data is reproduced, the control unit 110 transmits the reproduced images to the image processing unit 140, and controls the image processing unit 140, the liquid crystal control unit 150, and the light source control unit 160, similar to the regular projection processing performed in step S230.

In the "file reception and display mode", the control unit 110 reproduces still and video images of the still and moving image data received from the communication unit 193. Then, the control unit 110 sequentially transmits, for example, video images of the reproduced moving image data to the image processing unit 140, and controls the image processing unit 140, the liquid crystal control unit 150, and the light source control unit 160, similar to the regular projection processing performed in step S230.

When the still image data is reproduced, the control unit 110 transmits the reproduced images to the image processing unit 140, and controls the image processing unit 140, the liquid crystal control unit 150, and the light source control unit 160, similar to the regular projection processing performed in step S230.

<Configurations of Liquid Crystal Control Unit and Liquid Crystal Devices>

Operations of the liquid crystal control unit 150 of the liquid crystal projector 100 according to the present exemplary embodiment, and operations of the liquid crystal devices 151R, 151G, and 151B will be described below with reference to FIGS. 3, 4, and 5. Since operations of the liquid crystal devices 151G and 151B are controlled in a similar way to the liquid crystal device 151R, control operations of only the liquid crystal device 151R will be described below.

To simplify the descriptions, the present exemplary embodiment will be described below on the premise that the transmissivity of each pixel of each of the liquid crystal device 151R can be the transmissivity corresponding to 8 gradations ("gradation 0" for the lightest gradation and "gradation 7" for the deepest gradation). In the present exemplary embodiment, the image processing unit 140 transmits a vertical synchronization signal, a horizontal synchronization signal, a data signal of pixel value (indicating gradation) for each color component, and a data clock signal.

Figure 3:
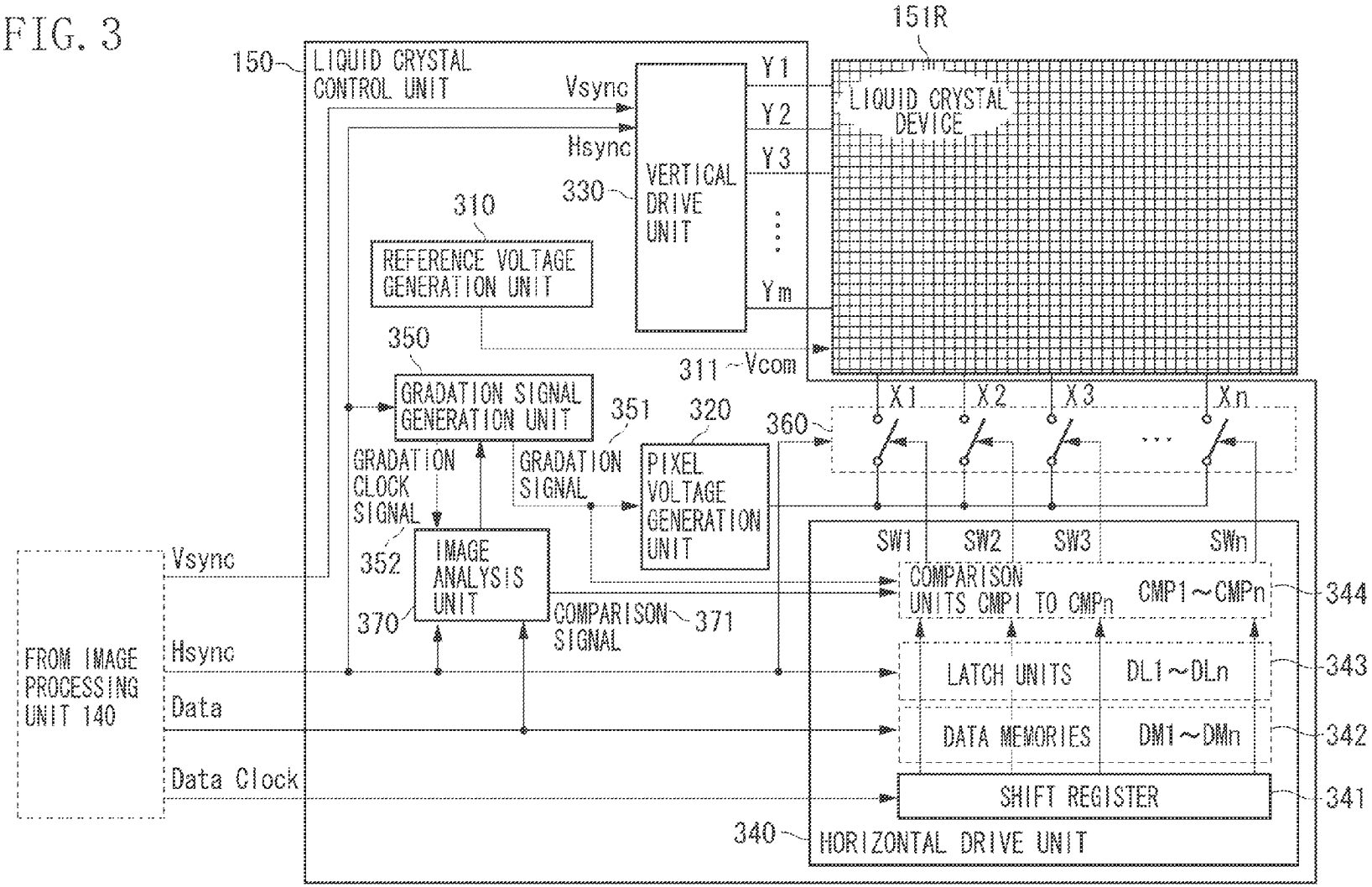
FIG. 3 is a block diagram illustrating a configuration of a liquid crystal control unit according to the present exemplary embodiment.

FIG. 3 is a block diagram illustrating a configuration of the liquid crystal control unit 150 according to the present exemplary embodiment. FIG. 4 is a diagram illustrating a configuration of the liquid crystal device 151R according to the present exemplary embodiment. FIG. 5 is a diagram illustrating signals generated by the gradation signal generation unit 350 and the image analysis unit 370 according to the present exemplary embodiment.

In the following descriptions, each pixel of the liquid crystal on the liquid crystal device 151R is referred to as "a liquid crystal pixel", and each pixel of an input image signal (data signal) is referred to as "an image pixel."

A regular configuration of the liquid crystal device 151R of the liquid crystal projector 100 will be described below. The liquid crystal device 151R generally includes a first polarizing filter, a first glass substrate, a first transparent electrode, a first oriented film, a liquid crystal layer, a second oriented film, a second transparent electrode, a second glass substrate, and a second polarizing filter. Light with polarization direction polarized by the first polarizing filter is supplied to the liquid crystal layer. Only light with a polarization direction that can pass through the second polarizing filter, out of light with polarization directions adjusted by the liquid crystal layer, passes through the second polarizing filter. Thus, the transmissivity (transmitted light quantity) is controlled.

The liquid crystal layer is composed of a liquid crystal sandwiched between the first and second oriented films, with which molecules are arranged in a fixed direction. The liquid crystal layer is sandwiched by the first and second transparent electrodes. Applying different voltages to the first and second transparent electrodes produces a potential difference at a position corresponding to each pixel of the liquid crystal layer, thus applying a voltage to the liquid crystal.

Since the liquid crystal has characteristics that the molecular arrangement changes according to the applied voltage, the degree of light polarization of the liquid crystal corresponding to each pixel changes accordingly. Thus, changing the polarization direction of light with polarization direction polarized by the first polarizing filter enables adjusting the transmissivity (transmitted light quantity) of the second polarizing filter.

Referring to FIG. 3, the liquid crystal control unit 150 includes a reference voltage generation unit 310, a pixel voltage generation unit 320, a vertical drive unit 330, a horizontal drive unit 340, a gradation signal generation unit 350, a switch group 360, and an image analysis unit 370. The horizontal drive unit 340 includes a shift register 341, a data memory 342, a latch unit 343, and a comparison unit 344.

Figure 4:
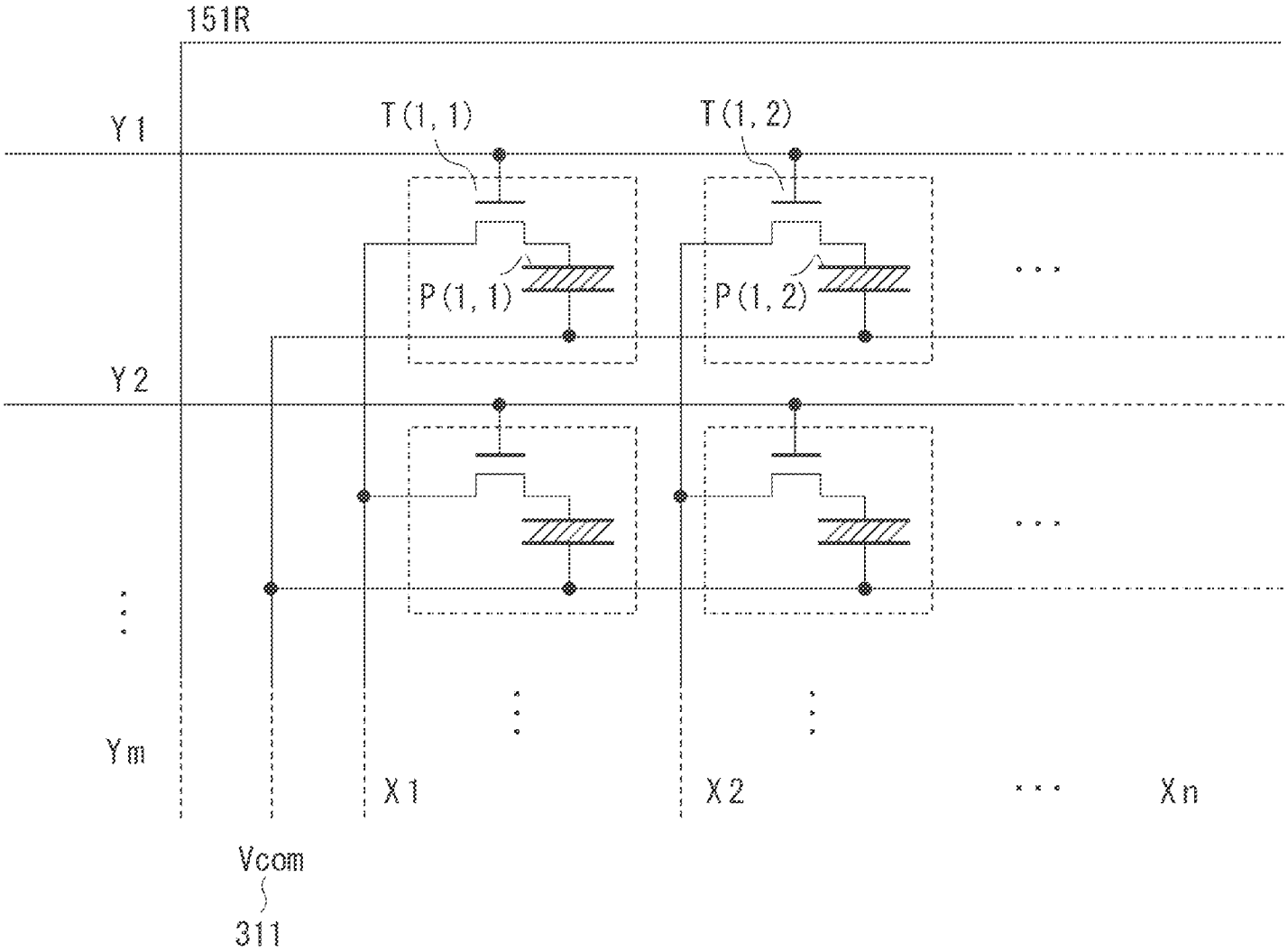
FIG. 4 illustrates a configuration of a liquid crystal device according to the present exemplary embodiment.

As illustrated in FIGS. 3 and 4, the liquid crystal device 151R includes M gate row lines Y1 to Ym and N data column lines X1 to Xn corresponding to pixels of M rows×N columns arranged on a substrate. A thin film transistor T (m, n), which is a switching device corresponding to each pixel, is arranged at each point of intersection of these gate row and data column lines. A signal from a gate row line Y is supplied to the gate electrode of the thin film transistor T (m, n), and a signal from a data column line Xis supplied to the source electrode thereof.

A pixel electrode P (m, n) is connected to the drain electrode of the thin film transistor T (m, n). A signal from a source column line X is supplied to the pixel electrode P (m, n) only while a signal is being input from the gate row line Y.

Meanwhile, the other side of the pixel electrode P is a common electrode to which a Vcom voltage 311 (constant voltage) generated by the reference voltage generation unit 310 is supplied. With the thus-configured liquid crystal device 151R according to the present exemplary embodiment, the voltage applied to the liquid crystal between the common electrode and the pixel electrode P is adjusted by the difference between the voltage (Vcom) of the common electrode and the voltage of the pixel electrode P (a voltage applied from the data column lines X).

Referring to FIG. 3, the reference voltage generation unit 310 generates the Vcom voltage 311 (constant voltage) to be supplied to the common electrode of the liquid crystal device 151R.

The pixel voltage generation unit 320 generates a pixel voltage to be applied to the data column lines X. A pixel voltage generated by the pixel voltage generation unit 320 is supplied to the data lines X1 to Xn of the liquid crystal device 151R via the switch group 360.

In the present exemplary embodiment, a pixel voltage is generated based on a gradation signal 352 (a ramp signal in the present exemplary embodiment) corresponding to each gradation (gradations 0 to 7) generated by the gradation signal generation unit 350.

When the gradation signal 352 has a value corresponding to gradation 3, for example, the pixel voltage generation unit 320 generates a voltage required to provide the transmissivity of each liquid crystal pixel of the liquid crystal device 151R corresponding to gradation 3.

Specifically, the pixel voltage generation unit 320 generates a voltage required to provide the transmissivity of each liquid crystal pixel of the liquid crystal device 151R corresponding to each gradation, according to the input value (indicating a gradation) of the gradation signal 352.

With this configuration, the pixel voltage supplied from the data column lines X is supplied to the pixel electrode for each liquid crystal pixel of the liquid crystal device 151R according to the present exemplary embodiment, enabling changing the transmissivity of the liquid crystal by the potential difference between the voltage of the pixel electrode and the voltage Vcom of the common electrode.

Turning off each switch corresponding to pixel electrodes by using the switch group 360 at a timing when the voltage corresponding to the gradation of each pixel is supplied from the pixel voltage generation unit 320 enables adjusting the transmissivity of the liquid crystal to the transmissivity according to the pixel value of each pixel of an input image. The horizontal drive unit 340 controls the ON/OFF state of each switch of the switch group 360.

When a low voltage is applied to the liquid crystal, the transmissivity of the liquid crystal device 151R according to the present exemplary embodiment becomes low. When a high voltage is applied to the liquid crystal, the transmissivity thereof becomes high. However, the relation between the applied voltage and the transmissivity may be reversed.

As long as the pixel voltage generation unit 320 generates a voltage required to provide the transmissivity of each liquid crystal pixel of the liquid crystal device 151R corresponding to each gradation, according to the input value (indicating a gradation) of the gradation signal 352, the voltage may change in any way.

In the present exemplary embodiment, when a monotonically increasing ramp signal is input from the gradation signal generation unit 350 as the gradation signal 352, the pixel voltage generation unit 320 generates a monotonically increasing pixel voltage.

However, a monotonically decreasing pixel voltage may be generated based on the monotonically increasing ramp signal as the gradation signal 352. This is based on the characteristics that, regardless of the polarity of a voltage from the pixel electrode P to the common electrode (positive or negative voltage), applying the voltage having the same absolute value to the liquid crystal enables similarly controlling the orientation of the liquid crystal. Specifically, even if a ramp signal monotonically increasing for each period of the horizontal synchronization signal is input, the pixel voltage generation unit 320 may generate a voltage which increases centering on the Vcom voltage 311 or a voltage which decreases centering thereon.

Referring to FIG. 3, the vertical drive unit 330 acquires a horizontal synchronization signal of an image transmitted from the image processing unit 140, and sequentially supplies a gate signal to the gate row lines Y1 to Ym of the liquid crystal device 151R at a timing according to the horizontal synchronization signal. The vertical drive unit 330 may acquire a vertical synchronization signal. For example, if the vertical drive unit 330 detects a change in the horizontal synchronization signal twice since it has detected a change in the vertical synchronization signal, the vertical drive unit 330 supplies a signal to the gate row line Y1 and does not supply the relevant signal to other gate row lines Y2 to Ym.

Then, when the vertical drive unit 330 detects a change in the horizontal synchronization signal, it supplies a signal to the gate row line Y2 and does not supply the relevant signal to other gate row lines Y1 and Y3 to Ym. Thus, each time the vertical drive unit 330 according to the present exemplary embodiment detects a change in the horizontal synchronization signal, it sequentially changes the destination of signal supply (gate row lines Y1 to Ym).

When the vertical drive unit 330 detects a change in the vertical synchronization signal, it supplies a signal to the gate row line Y1 if it detects a change in the horizontal synchronization signal twice after detecting a change in the vertical synchronization signal even if signal supply up to the gate row line Ym is not completed.

The vertical drive unit 330 supplies a signal to the gate row line Y1 when it detects the horizontal synchronization signal for the second time so that the vertical drive unit 330 waits at least until a data signal for one row has been input to the level control unit 340.

When the vertical drive unit 330 supplies a signal to the gate row line Y1, in the liquid crystal device 151R according to the present exemplary embodiment, thin film transistors T(1, 1) to T(1, n) conduct to enable applying to pixel electrodes P (1, 1) to P (1, n) the voltage supplied by the data column lines X1 to Xn, respectively. In this case, since thin film transistors other than the thin film transistors T (1, 1) to T (1, n) do not conduct, the voltage supplied by the data column lines X1 to Xn is not applied to any pixel electrodes other than the pixel electrodes P (1, 1) to P (1, n).

Likewise, when the vertical drive unit 330 supplies a signal to the gate row line Y1, thin film transistors T (2, 1) to T (2, n) conduct to enable applying to pixel electrodes P (2, 1) to P (2, n) the voltage supplied by the data column lines X1 to Xn, respectively. Subsequently, this operation is repeated for up to the gate row line Ym.

The horizontal drive unit 340 acquires the horizontal synchronization signal, the data signal, and the data clock transmitted from the image processing unit 140, and further acquires the gradation signal 352 (a ramp signal in the present exemplary embodiment) transmitted from the gradation signal generation unit 350 and a comparison signal transmitted from the image analysis unit 370. Then, based on the acquired signals, the horizontal drive unit 340 controls the ON/OFF state of the switch group 360.

As described above, in the present exemplary embodiment, the pixel voltage generated by the pixel voltage generation unit 320 is supplied to the data column lines X1 to Xn of the liquid crystal device 151R via the switch group 360, based on the gradation signal 352 from the gradation signal generation unit 350.

The horizontal drive unit 340 maintains the ON state of each switch of the switch group 360 until the gradation signal 352 transmitted from the gradation signal generation unit 350 coincides with the pixel value of each image pixel corresponding to the data column lines X1 to Xn. When the gradation signal 352 coincides with the pixel value of each pixel corresponding to the data column lines X1 to Xn, the horizontal drive unit 340 turns off each switch of the switch group 360 for the matched data column lines.

Thus, the horizontal drive unit 340 controls the ON/OFF state of each switch of the switch group 360 to control the supply state of the pixel voltage to the pixel electrode for each liquid crystal pixel of the liquid crystal device 151R. Operations of the horizontal drive unit 340 will be described below.

The gradation signal generation unit 350 generates the gradation signal 352 and a gradation clock signal 351 (a synchronization signal of the gradation signal 352) in synchronization with the horizontal synchronization signal of the image signal. Then, the gradation signal generation unit 350 supplies the gradation signal 352 to the pixel voltage generation unit 320 and the horizontal drive circuit 340, and supplies the gradation clock signal 351 to the image analysis unit 370.

Figure 5:
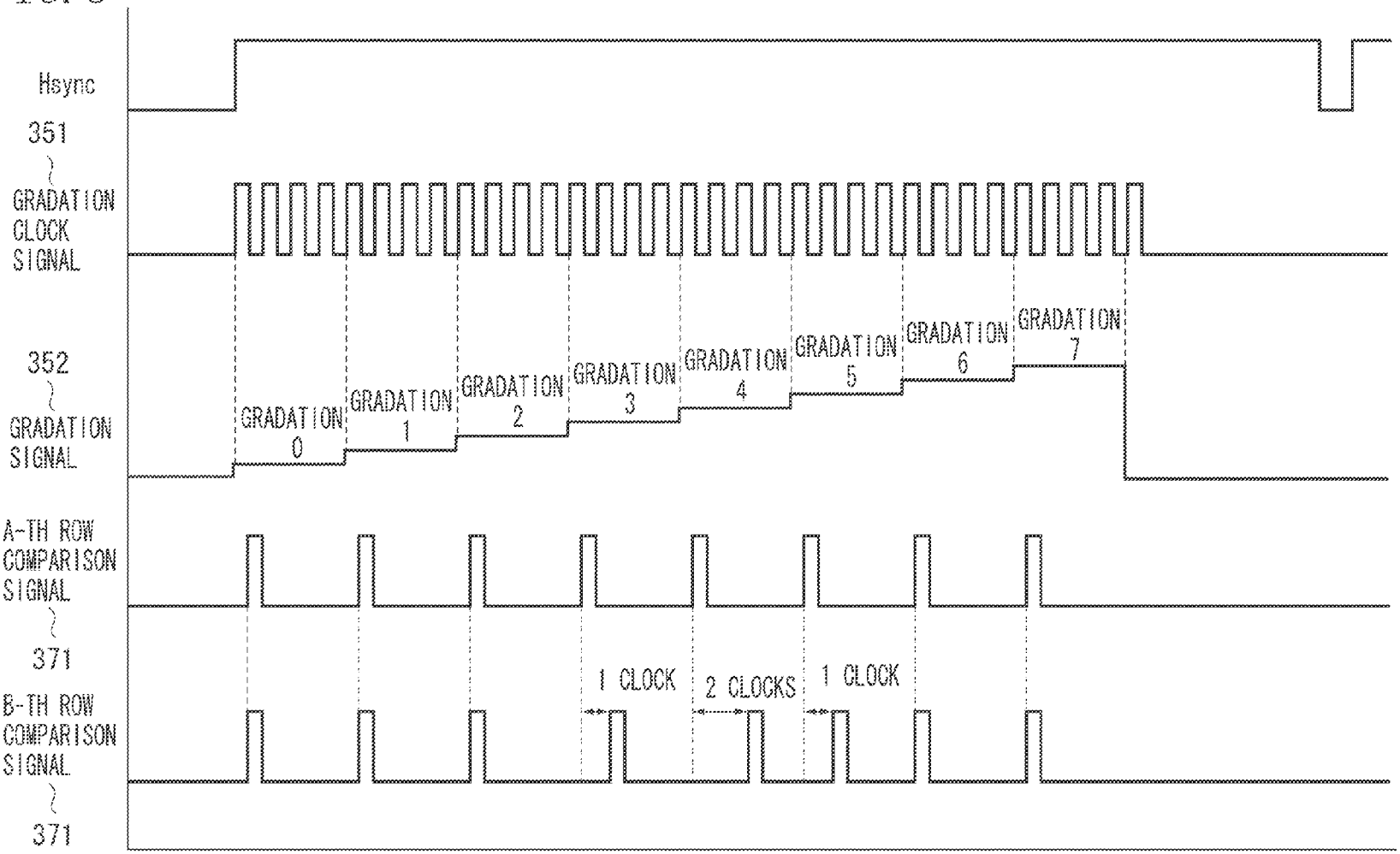
FIG. 5 is a diagram illustrating signals generated by a gradation signal generation unit and an image analysis unit according to the present exemplary embodiment.

As illustrated in FIG. 5, the gradation signal 352, which is a monotonically increasing ramp signal, is a digital signal indicating values corresponding to respective gradations (gradations 0 to 7) in a period of the horizontal synchronization signal. The gradation signal 352 increases the signal value by one gradation for each four clocks of the gradation clock signal 351.

The switch group 360 selects whether the pixel voltage from the pixel voltage generation unit 320 is to be supplied to the data column lines X1 to Xn of the liquid crystal device 151R. For example, the switch group 360 includes a plurality of physical switches, a plurality of switching devices, or a plurality of logical switches.

When a change in the horizontal synchronization signal is detected, the switch group 360 turns on each switch. On the other hand, when a signal for turning off each switch is input from the horizontal drive unit 340, the switch group 360 turns off each switch specified to be turned off. The image analysis unit 370 acquires the horizontal synchronization signal and the data signal transmitted from the image processing unit 140 and the gradation clock signal 351 transmitted from the gradation signal generation unit 350, and transmits a comparison signal 371 to the horizontal drive unit 340.

In the present exemplary embodiment, the comparison signal 371 is used to determine a timing when the comparison unit 344 of the horizontal drive unit 340 compares the data of the latch unit 343 with the value of the gradation signal 352. Then, the image analysis unit 370 transmits to the horizontal drive unit 340 the comparison signal 371 at a timing based on the value of the data signal of the image signal transmitted from the image processing unit 140.

Operations of the image analysis unit 370 will be described below. The comparison unit 344 of the horizontal drive unit 340 may not determine based on the comparison signal 371 a timing of comparing the data of the latch unit 343 with the value of the gradation signal 352. Instead, the comparison unit 344 may change an output timing of the signal for turning off each switch of the switch group 360.

<Liquid Crystal Device Control Operations by Liquid Crystal Control Unit>

Operations performed by the liquid crystal control unit 150 according to the present exemplary embodiment to control the liquid crystal device 151R will be described below with reference to FIGS. 3, 5, 6A, 6B, 6C, and 6D.

FIGS. 6A to 6D illustrate a result of analysis by the image analysis unit 370, and tables for determining a delay amount of the comparison signal 371. FIG. 6A illustrates for each row a result of analysis by the image analysis unit 370. FIG. 6B illustrates the number of image pixels for each gradation, and a delay amount of transmission timing of the comparison signal 371 corresponding to a gradation following the relevant gradation. The unit of delay amount is the number of clocks of the gradation clock signal 351.

FIG. 6C illustrates for each row a delay amount of transmission timing of the comparison signal 371 corresponding to a gradation following each gradation based on the analysis result (see FIG. 6A) and the delay amount (see FIG. 6B). FIG. 6D is a table, converted from the table in FIG. 6C, illustrating for each row a delay amount of transmission timing of the comparison signal 371 corresponding to each gradation.

As illustrated in FIGS. 6C and 6D, the transmission timing of the comparison signal 371 is delayed from the regular timing by 1 to 3 clocks of the gradation clock signal 351. As a result, the output timing of the signal for turning on/off each switch of the switch group 360 can be delayed from the regular timing.

When an image signal is input from the image processing unit 140, the vertical synchronization signal, the horizontal synchronization signal, the data signal, and the data clock signal are provided to each block of the liquid crystal control unit 150, as described referring to FIG. 3.

In the horizontal drive unit 340, the data clock signal is supplied to the shift register 341, the data signal is supplied to the data memory 342, and the horizontal synchronization signal is supplied to the latch unit 343. The gradation signal 352 output from the gradation signal generation unit 350 and the comparison signal 371 output from the image analysis unit 370 are supplied to the comparison unit 344.

In the horizontal drive unit 340, based on the data clock signal transmitted from the image processing unit 140, the shift register 341 controls operations for recording in the data memory 342 the data signal transmitted from the image processing unit 140. The data memory 342 stores data (pixel value) corresponding to each image pixel for one row of the data signal transmitted from the image processing unit 140.

The latch unit 343 reads and latches data (pixel value of each image pixel) of the data memory 342 at a timing of detection of a change in the horizontal synchronization signal transmitted from the image processing unit 140. More specifically, after the data signal for the 1st row is stored in the data memory 342, the latch unit 343 reads and latches the pixel value of each image pixel of the 1st row stored in the data memory 342, at a timing when the horizontal synchronization signal for the 2nd row is input.

Then, the comparison unit 344 compares the gradation signal 352 (ramp signal) indicating each gradation supplied from the gradation signal generation unit 350 with the pixel value of each image pixel latched by the latch unit 343 at a timing when the comparison signal 371 transmitted from the image analysis unit 370 is input. When the pixel value of each image pixel of the latch unit 343 corresponding to each image pixel coincides with the gradation signal 352, the comparison unit 344 transmits control signals SW1 to SWn for turning off each switch of the switch group 360 corresponding to the matched image pixels.

The comparison unit 344 may compare in advance the gradation signal 352 (ramp signal) indicating each gradation supplied from the gradation signal generation unit 350 with the data (pixel value) of the image pixel latched by the latch unit 343.

In this case, when the value of the latch unit 343 corresponding to each image pixel coincides with the gradation signal 352 at a timing when the comparison signal 371 transmitted from the image analysis unit 370 is input, the comparison unit 344 transmits the control signals SW1 to SWn for turning off each switch of the switch group 360 corresponding to the matched pixels.

As described above, according to the input of the gradation signal 352, the switch group 360 is supplied with a voltage for providing the transmissivity of each liquid crystal pixel corresponding to the value indicated by the input gradation signal 352. Then, as described above, when the gradation indicated by the gradation signal 352 coincides with the pixel value of each image pixel, the horizontal drive unit 340 turns off each switch of the switch group 360. Therefore, a pixel voltage according to the pixel value of each image pixel is supplied from the data column lines X via the switch group 360.

The above-described operations allows inputting a signal to the gate row line Y1 from the vertical drive unit 330, and supplying a pixel voltage according to the pixel value of each image pixel from the data column lines X1 to Xn respectively to the pixel electrodes P (1, 1) to P (1, n) for each liquid crystal pixel of the 1st row of the liquid crystal device 151R.

Thus, the transmissivity of each liquid crystal pixel of the 1st row is adjusted to the transmissivity according to the pixel value of each image pixel. The liquid crystal control unit 150 according to the present exemplary embodiment sequentially repeats the above-described operations from the 1st to M-th rows to enable sequentially controlling the transmissivity of each liquid crystal pixel of each row of the liquid crystal device 151R.

Then, the liquid crystal control unit 150 enables transmission of the light of red (R) from the color separation unit 162 through the liquid crystal device 151R, thus supplying to the color combination unit 163 the red light corresponding to the red gradation of the input image. Then, the color combination unit 163 combines the green (G) and blue (B) light with the red (R) light, and the projection optical system 171 projects the combined light. Thus, an image corresponding to the input image can be projected on the screen.

Operations of the image analysis unit 370 according to the present exemplary embodiment will be described below. To simplify descriptions, a case where image data including 60 pixels vertically and 120 pixels horizontally is displayed is exemplified. In this case, one horizontal row includes 120 image pixels.

In the present exemplary embodiment, when there are not so many pixels displaying each gradation out of image pixels in one row (regular case), the comparison signal 371 is transmitted once for each 4 clocks of the gradation clock 352, like the comparison signal for the A-th row illustrated in FIG. 5. Further, like the comparison signal for the A-th row illustrated in FIG. 5, the comparison signal 371 is transmitted within one clock of the gradation clock 352 after the value of the gradation signal 352 has increased. Although, in the present exemplary embodiment, the comparison signal 371 is regularly transmitted in this way, the present invention is not limited thereto.

As described above, based on input image data for one row, the image analysis unit 370 transmits to the comparison unit 344 of the horizontal drive unit 340 the pixel value latched by the latch unit 343 and the comparison signal 371 for determining a timing of comparison with the gradation signal 352.

The comparison unit 344 may not perform the comparison at the timing of reception of the comparison signal 371. Instead, the comparison unit 344 may transmit a signal for turning off each switch corresponding to each data column line X of the switch group 360 according to the timing of reception of the comparison signal 371.

In this case, the comparison signal 371 is not a signal for determining a timing of comparing the pixel value latched by the latch unit 343 with the gradation signal 352 but a signal for determining an output timing of a signal for controlling each switch of the switch group 360.

Therefore, the image analysis unit 370 performs image analysis of image data for one row input as a data signal. Specifically, the image analysis unit 370 analyzes input image data for one row and counts the number of pixels for each gradation.

Although, in the present exemplary embodiment, the image analysis unit 370 performs image analysis each time image data for one row is input, it may perform image analysis for each row of image data for one frame as long as the liquid crystal control unit 150 includes a memory for buffering image data for one frame.

FIG. 6A illustrates a result of image analysis. According to the analysis result, the 1st row includes 15 pixels for each of gradations 0 to 7. The A-th row includes 15 pixels for gradation 0, 25 pixel for gradation 1, 15 pixels for gradation 2, 5 pixels for gradation 3, 15 pixels for gradation 4, 5 pixels for gradation 5, 20 pixels for gradation 6, and 20 pixels for gradation 7.

The B-th row includes zero pixels for gradation 0, 0 pixels for gradation 1, 30 pixels for gradation 2, 60 pixels for gradation 3, 30 pixels for gradation 4, 0 pixels for gradation 5, 0 pixels for gradation 6, and 0 pixels for gradation 7.

To change the timing of turning off the pixel voltage supply to each liquid crystal pixel corresponding to the image pixel of a gradation next to the gradation with many pixel counts, the image analysis unit 370 changes the timing of transmitting the comparison signal 371 to the comparison unit 344. As described above, the horizontal drive unit 340 compares the gradation signal 352 with the pixel value of the latch unit 343 at a timing of reception of the comparison signal 371.

Therefore, changing the transmission timing of the comparison signal 371 enables changing the timing of executing the comparison by the comparison unit 344, thus changing the timing of turning off each switch of the switch group 360. The transmission timing of the comparison signal 371 is determined by the image analysis unit 370 based on the table illustrated in FIG. 6B.

More specifically, with the image signal for the 1st row illustrated in FIG. 6A, the number of pixels is 29 or less for all gradations according to the table illustrated in FIG. 6B. Therefore, the transmission timing of the comparison signal 371 corresponding to a gradation next to each gradation is not delayed. Therefore, with the image signal for the 1st row, the delay amount of the comparison signal 371 corresponding to a gradation next to the relevant gradation is 0, as illustrated in FIG. 6C.

With the image signal for the 1st row illustrated in FIG. 6A, the number of pixels is 29 or less for all gradations according to the table illustrated in FIG. 6B. Therefore, the transmission timing of the comparison signal 371 corresponding to a gradation next to each gradation is not delayed. Therefore, with image signal of the A-th row, the delay amount of the comparison signal 371 corresponding to a gradation next to the relevant gradation is 0, as illustrated in FIG. 6C.

With the image signal of the B-th row illustrated in FIG. 6A, the transmission timing of the comparison signal 371 corresponding a gradation next to each of gradations 2, 3, and 4 according to the table illustrated in FIG. 6B. Specifically, since the number of pixels for gradation 2 is 30, the delay amount of the comparison signal 371 corresponding to the next gradation (gradation 3) is set as one clock of the gradation clock signal 351 according to the table illustrated in FIG. 6B.

Since the number of pixels for gradation 3 is 60, the delay amount of the comparison signal 371 corresponding to the next gradation (gradation 4) is set as two clocks of the gradation clock signal 351 according to the table illustrated in FIG. 6B. Since the number of pixels for gradation 4 is 30, the delay amount of the comparison signal 371 corresponding to the next gradation (gradation 5) is set as one clock of the gradation clock signal 351 according to the table illustrated in FIG. 6B.

Therefore, with the image signal of the B-th row, the delay amount of the comparison signal corresponding to a gradation next to each of the gradations 2, 3, and 4 is 1 clock, 2 clocks, and 1 clock, respectively, as illustrated in FIG. 6C. Referring to the table in FIG. 6D, which is converted from the table in FIG. 6C, the delay amount of the comparison signal 371 corresponding to gradation 3 is 1 clock, the delay amount of the comparison signal 371 corresponding to gradation 4 is 2 clocks, and the delay amount of the comparison signal 371 corresponding to gradation 5 is 1 clock.

According to the present exemplary embodiment, for example, at a moment 60 switches of the switch group 360 are turned off at the same time to display gradation 3 in the B-th row, a turbulence arises in the pixel voltage supplied from the pixel voltage generation unit 320. Accordingly, the pixel voltage corresponding to a gradation (gradation 4) next to gradation 3 is also affected by turbulence.

This turbulence decreases with time. In the present exemplary embodiment, a switch of the pixel corresponding to the next gradation (gradation 4) is turned off at a timing later than the regular timing so that the switch group 360 may not be turned off to display the next gradation (gradation 4) in a time period when the turbulent pixel voltage becomes turbulent. Thus, it is possible to prolong the time period between the timing of changing the supply state of the pixel voltage corresponding to gradation 3 and the timing of changing the supply state of the pixel voltage corresponding to gradation 4.

Therefore, since the switch of each pixel of the next gradation (gradation 4) is turned off after turbulence in the pixel voltage has been reduced to some extent, the degradation of pixels for gradation 4 can be reduced.

According to the present exemplary embodiment, the comparison signal 371 is transmitted once for each 4 clocks of the gradation clock 352 like the comparison signal for the A-th row illustrated in FIG. 5. Further, when there are not so many pixels displaying each gradation, the comparison signal 371 is transmitted within 1 clock of the gradation clock 352 after the value of the gradation signal 352 has increased, like the comparison signal for the A-th row illustrated in FIG. 5.

Although, in the present exemplary embodiment, the comparison signal 371 is normally transmitted in this way, the present invention is not limited thereto. For example, unlike the example illustrated in FIG. 5, the comparison signal 371 may be transmitted at the fourth clock of the gradation clock 352 after the value of the gradation signal 352 has increased. In this case, the transmission timing of the comparison signal 371 corresponding to a gradation itself involving many pixels to be displayed is brought forward, for example, by 1 to 3 clocks.

Specifically, the present invention is not limited to delaying the transmission timing of the comparison signal 371. The comparison signal 371 may be transmitted at the third clock of the gradation clock 352 after the value of the gradation signal 352 has increased. In this case, the transmission timing of the comparison signal 371 corresponding to a gradation itself involving many pixels to be displayed may be brought forward, for example, by 1 to 2 clocks, or the transmission timing of the comparison signal 371 corresponding to a gradation next to the gradation involving many pixels to be displayed may be delayed by 1 clock.

Specifically, the LCD apparatus according to the present exemplary embodiment may preferably control the transmission timing of the comparison signal 371 corresponding to the gradation itself involving many pixels to be displayed and/or the transmission timing of the comparison signal 371 corresponding to a gradation following the gradation involving many pixels to be displayed.

As described above, the LCD apparatus according to the present exemplary embodiment compares the gradation signal 352 with the pixel value in one row of the image to be displayed to control the supply state of the pixel voltage based on the gradation signal 352 supplied to each liquid crystal pixel.

Then, in the gradation signal 352, when displaying the second gradation next to the first gradation, it is possible to change the time period between the timing of changing the supply state of the pixel voltage corresponding to the first gradation and the timing of changing the supply state of the pixel voltage corresponding to the second gradation.

When there are many pixels for the first gradation of the image data in one row, this time period is controlled to be longer than that when there are fewer pixels for the first gradation. Therefore, the LCD apparatus according to the present exemplary embodiment controls the timing of changing the supply state of the pixel voltage corresponding to the first gradation and/or the timing of changing the supply state of the pixel voltage corresponding to the second gradation.

As described above, according to the LCD apparatus of the present exemplary embodiment, it is possible to prolong the release timing of each switch of the switch group 360 corresponding to the first gradation involving many pixels to be displayed and the release timing of each switch of the switch group 360 corresponding to the next gradation (second gradation) so that it becomes longer than that when there are a small number of pixels for the first gradation.

The above-described configuration enables turning off each switch of the switch group 360 corresponding to the second gradation next to the first gradation after the influence of turbulence in the pixel voltage (generated when each switch of the switch group 360 corresponding to the first gradation involving many pixels to be displayed) has been reduced, thus preventing image degradation.

Although the LCD apparatus according to the present exemplary embodiment controls the timing of changing the supply state of the pixel voltage corresponding to the first gradation and/or the timing of changing the supply state of the pixel voltage corresponding to the second gradation without changing the waveform of the gradation signal 352, the configuration is not limited thereto.

Figure 7:
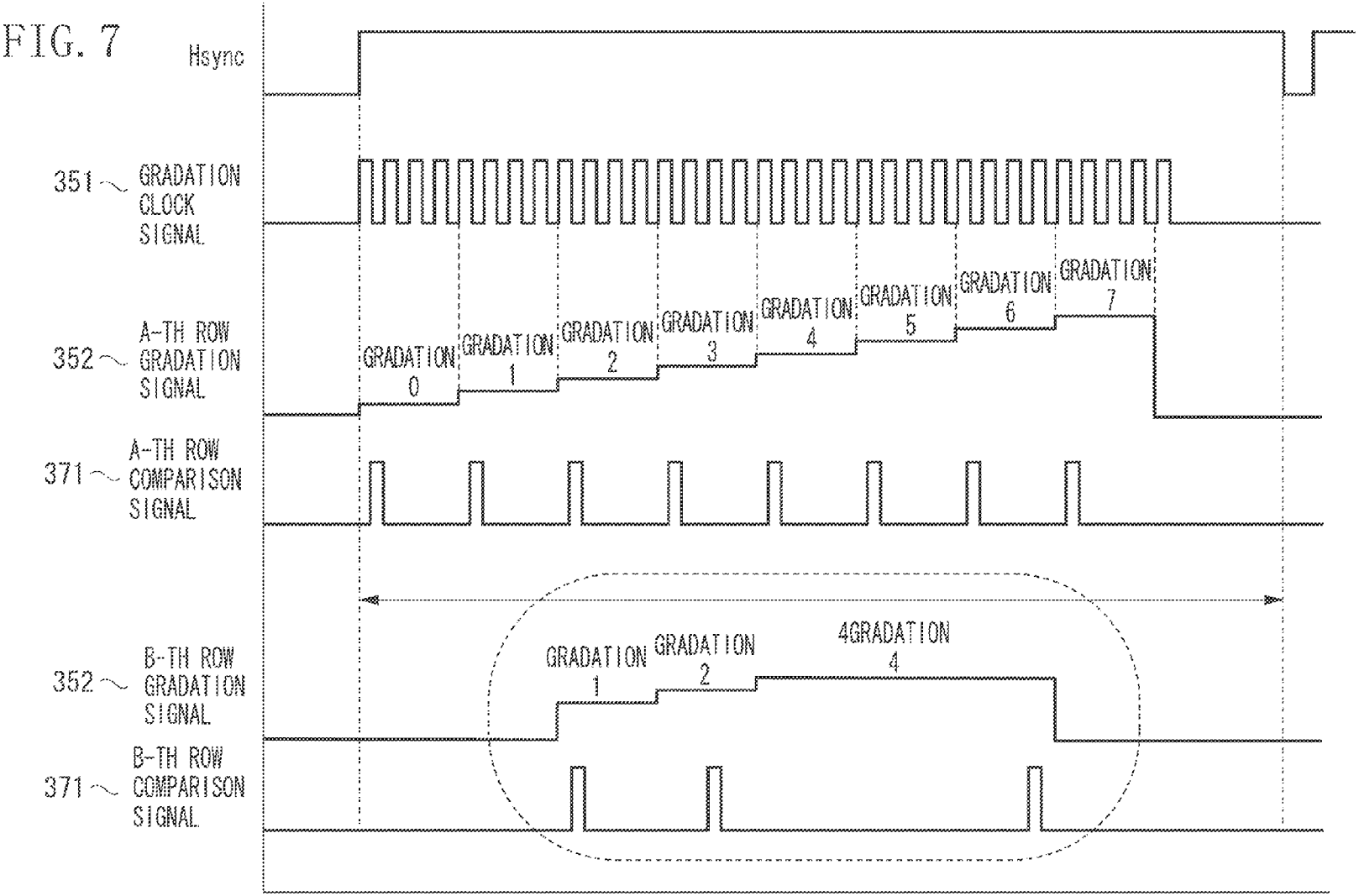
FIG. 7 is a diagram illustrating signals generated by the gradation signal generation unit and the image analysis unit according to the present exemplary embodiment.
Figure 8A:
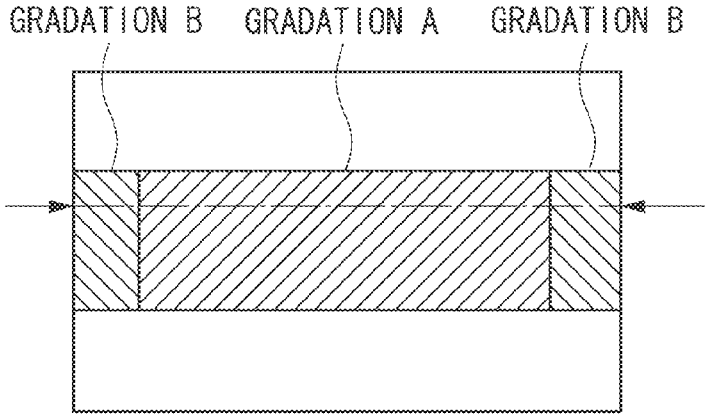
FIGS. 8A and 8B illustrates operations of a conventional technique.
Figure 8B:
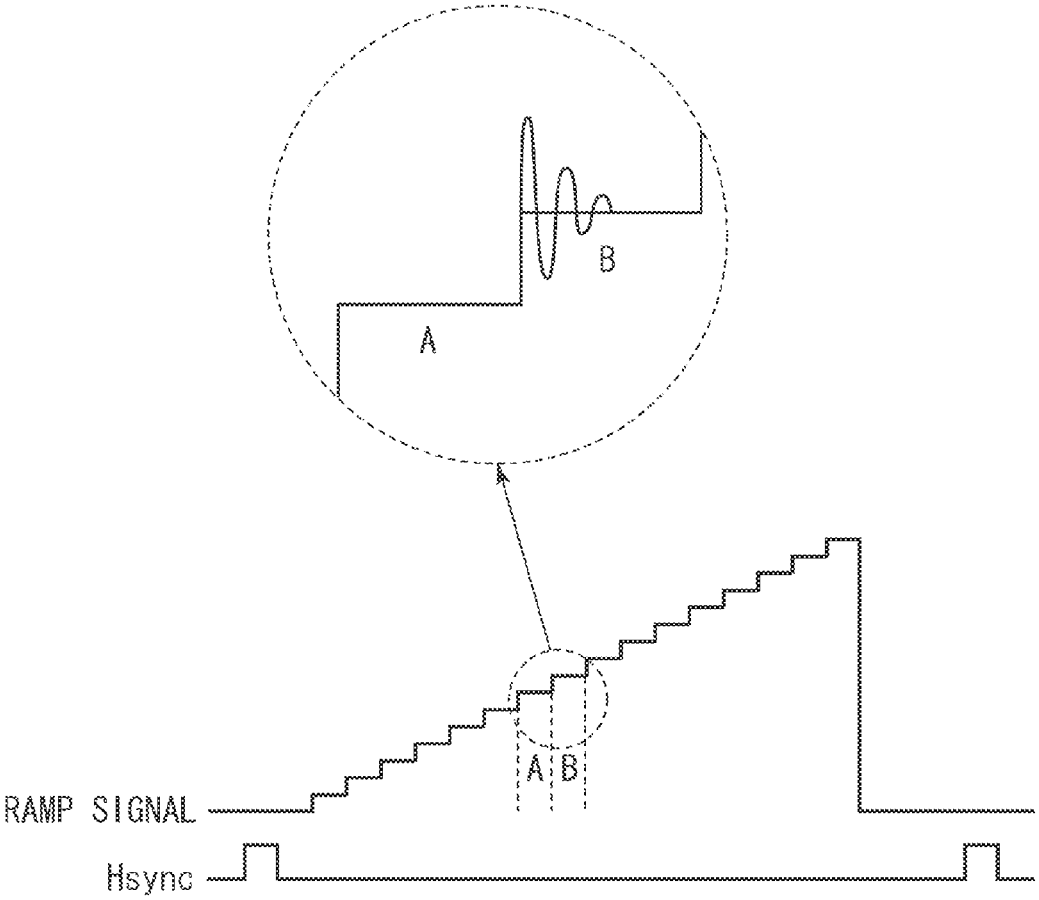

For example, when there are many pixels for a specific gradation, the image analysis unit 370 may control the gradation signal generation unit 350 to prolong the time period during which a signal indicating the first gradation and/or a signal indicating the second gradation are output. An example of a waveform of the gradation signal 352 and an example of an output waveform of the comparison signal 371 are illustrated in FIG. 7.

Referring to these examples, when displaying the image of the B-th row according to the present exemplary embodiment, the image analysis unit 370 controls the gradation signal gene ration unit 350 to generate the gradation signal 352 not containing a signal of a gradation not to be displayed to prolong the output timing of the comparison signal 371 so that it becomes longer than that when there are many pixels indicating each gradation. The output timing of the gradation signal 352 may be in any timing as long as it is within one period of the horizontal synchronization signal.

These examples also enable turning off each switch of the switch group 360 corresponding to the second gradation (a gradation next to the first gradation) after waiting sufficient time period until the influence of turbulence in the pixel voltage (generated when each switch of the switch group 360 corresponding to the first gradation involving many pixels is turned off) has been reduced.

In the present exemplary embodiment, a plurality of liquid crystal devices is provided to a liquid crystal projector of 3-panel type. However, a liquid crystal projector of single-panel type is provided with one liquid crystal device 151, and, instead of the color separation unit 162 and the color combination unit 163, a color wheel for enabling transmission of only light of each color component on a time sharing basis is arranged before or after the liquid crystal device.

Then, the liquid crystal control unit 150 controls the liquid crystal device 151 to provide the transmissivity corresponding to each color component at a timing of displaying each color component. Even with such a liquid crystal projector of single-panel type, it is also possible to analyze the number of pixels for each gradation to be displayed by each of the plurality of pixel electrodes to which a voltage is charged at the same time to prolong the time period between the timing of changing a voltage to the pixel electrode for a frequently displayed gradation and the time of charging a voltage to the pixel electrode for a gradation following the frequently displayed gradation. This method enables reducing image quality degradation similar to the liquid crystal projector of 3-panel type according to the present exemplary embodiment.

As described above, the LCD apparatus according to the present exemplary embodiment drives the liquid crystal device with a method for controlling, based on the gradation value (pixel value) of each image pixel corresponding to each of liquid crystal pixels, the supply state of the pixel voltage to be supplied to the pixel electrode of each liquid crystal pixel of the liquid crystal device generated based on a signal indicating gradations. When the value of the signal indicating the gradation indicates the value of the first gradation and then the value of the second gradation, when there are more pixels for the first gradation, it is possible to prolong the time period between the timing of changing the supply state of the pixel voltage corresponding to the first gradation and the timing of changing the supply state of the pixel voltage corresponding to the second gradation so that it becomes longer than that when there are a small number of pixels for the first gradation. With the above-described configuration, the present invention enables supplying the pixel voltage corresponding to the second gradation to the liquid crystal device in a time period during which there is a small influence of turbulence in the pixel voltage generated when there are a number of pixels for the first gradation, thus reducing degradation in an image for the second gradation to be displayed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-224185 filed Oct. 11, 2011, which is hereby incorporated by reference herein in its entirety.

What is claimed is:

1. A display apparatus comprising:

a liquid crystal device;

a gradation signal generation unit configured to generate a gradation signal which includes a first level and a second level higher than the first level and subsequent to the first level;

a voltage generation unit configured to generate a first pixel voltage to be supplied to one or more pixel electrodes corresponding to the first level, and a second pixel voltage to be supplied to one or more pixel electrodes corresponding to the second level; and a control unit configured to (a) determine whether or not a total number of pixels corresponding to the first level included in a row of an image is larger than a first predetermined number or a second predetermined number larger than the first predetermined number, (b) use a first delay amount to prolong a period of time between a timing of generating the first pixel voltage and a timing of generating the second pixel voltage if the total number of pixels corresponding to the first level included in the row of the image is larger than the first predetermined number and smaller than the second predetermined number, and (c) use a second delay amount larger than the first delay amount to prolong a period of time between a timing of generating the first pixel voltage and a timing of generating the second pixel voltage if the total number of pixels corresponding to the first level included in the row of the image is larger than the second predetermined number.

2. The display apparatus according to claim 1, wherein if the total number of pixels corresponding to the first level included in the row of the image is larger than the first predetermined number, the control unit delays the timing of generating the second pixel voltage so as to become later than if the total number of pixels corresponding to the first level included in the row of the image is smaller than the first predetermined number.

3. The display apparatus according to claim 1, wherein if the total number of pixels corresponding to the first level included in the row of the image is larger than the first predetermined number, the control unit brings forward the timing of generating the first pixel voltage so as to become earlier than if the total number of pixels corresponding to the first level included in the row of the image is smaller than the first predetermined number.

4. The display apparatus according to claim 1, wherein the gradation signal is generated by the gradation signal generation unit in synchronized with a horizontal synchronization signal of the image.

5. The display apparatus according to claim 1, wherein if a pixel corresponding to a specific level is not included in a row of the image, the control unit controls the gradation signal generation unit not to output the value corresponding to the specific level.

6. The display apparatus according to claim 1, wherein the liquid crystal device is configured to adjust a transmissivity of red, green, or blue light.

7. The display apparatus according to claim 1, wherein the gradation signal includes a signal whose value is increased at predetermined period of time.

8. The display apparatus according to claim 1, wherein the display apparatus is configured to act as a projector.

9. The display apparatus according to claim 1, further comprising an image capture unit configured to capture an image projected by the display apparatus.

10. A method for controlling a display apparatus including a liquid crystal device, comprising:

controlling a gradation signal generation unit to generate a gradation signal which includes a first level and a second level higher than the first level and subsequent to the first level;

controlling a voltage generation unit to generate a first pixel voltage to be supplied to one or more pixel electrodes corresponding to the first level, and a second pixel voltage to be supplied to one or more pixel electrodes corresponding to the second level;

determining whether or not a total number of pixels corresponding to the first level included in a row of an image is larger than a first predetermined number or a second predetermined number larger than the first predetermined number;

using a first delay amount to prolong a period of time between a timing of generating the first pixel voltage and a timing of generating the second pixel voltage if the total number of pixels corresponding to the first level included in the row of the image is larger than the first predetermined number and smaller than the second predetermined number, and using a second delay amount larger than the first delay amount to prolong a period of time between a timing of generating the first pixel voltage and a timing of generating the second pixel voltage if the total number of pixels corresponding to the first level included in the row of the image is larger than the second predetermined number.

11. The method according to claim 10, wherein if the total number of pixels corresponding to the first level included in the row of the image is larger than the first predetermined number, the timing of generating the second pixel voltage is delayed so as to become later than if the total number of pixels corresponding to the first level included in the row of the image is smaller than the first predetermined number.

12. The method according to claim 10, wherein if the total number of pixels corresponding to the first level included in the row of the image is larger than the first predetermined number, the timing of generating the first pixel voltage is brought forward so as to become earlier than if the total number of pixels corresponding to the first level included in the row of the image is smaller than the first predetermined number.

13. The method according to claim 10, wherein the gradation signal is generated by the gradation signal generation unit in synchronized with a horizontal synchronization signal of the image.

14. The method according to claim 10, further comprising controlling the gradation signal generation unit not to output the value corresponding to the specific level if a pixel corresponding to a specific level is not included in a row of the image.

15. The method according to claim 10, wherein the liquid crystal device is configured to adjust a transmissivity of red, green, or blue light.

16. The method according to claim 10, wherein the gradation signal includes a signal whose value is increased at predetermined period of time.

17. The method according to claim 10, wherein the display apparatus is configured to act as a projector.

18. The method according to claim 10, further comprising controlling an image capture unit to capture an image projected by the display apparatus.

19. A non-transitory storage medium that stores a program for causing a computer to execute a method for controlling a display apparatus including a liquid crystal device, the method comprising:

controlling a gradation signal generation unit to generate a gradation signal which includes a first level and a second level higher than the first level and subsequent to the first level;

controlling a voltage generation unit to generate a first pixel voltage to be supplied to one or more pixel electrodes corresponding to the first level, and a second pixel voltage to be supplied to one or more pixel electrodes corresponding to the second gradation level;

determining whether or not a total number of pixels corresponding to the first level included in a row of an image is larger than a first predetermined number or a second predetermined number larger than the first predetermined number;

using a first delay amount to prolong a period of time between a timing of generating the first pixel voltage and a timing of generating the second pixel voltage if the total number of pixels corresponding to the first level included in the row of the image is larger than the first predetermined number and smaller than the second predetermined number, and using a second delay amount larger than the first delay amount to prolong a period of time between a timing of generating the first pixel voltage and a timing of generating the second pixel voltage if the total number of pixels corresponding to the first level included in the row of the image is larger than the second predetermined number.

* * * * *